US010228095B2

(12) United States Patent
Liang

(10) Patent No.: US 10,228,095 B2
(45) Date of Patent: Mar. 12, 2019

(54) LED BULB APPLICABLE FOR INDUSTRIAL AUTOMATED PRODUCTION

(71) Applicant: Dongguan Chen Cai Illuminating Technology Co., Ltd., Dongguan (CN)

(72) Inventor: Faquan Liang, Dongguan (CN)

(73) Assignee: Dongguan Chen Cai Illuminating Technology Co., Ltd., Dongguan (CN)

( * ) Notice: Subject to any disclaimer, the term of this patent is extended or adjusted under 35 U.S.C. 154(b) by 130 days.

(21) Appl. No.: 15/605,432

(22) Filed: May 25, 2017

(65) Prior Publication Data

US 2018/0306386 A1 Oct. 25, 2018

(30) Foreign Application Priority Data

Apr. 25, 2017 (CN) ..... 2017 1 0276185

(51) Int. Cl.

| | |
|---|---|
| ***F21K 9/238*** | (2016.01) |
| ***F21K 9/66*** | (2016.01) |
| ***F21K 9/237*** | (2016.01) |
| ***F21V 23/00*** | (2015.01) |
| *F21Y 115/10* | (2016.01) |

(52) U.S. Cl.

CPC ..... *F21K 9/238* (2016.08); *F21K 9/237* (2016.08); *F21K 9/66* (2016.08); *F21V 23/006* (2013.01); *F21Y 2115/10* (2016.08)

(58) Field of Classification Search

CPC ..... F21Y 2115/10; F21Y 2107/00; F21Y 2103/10; F21Y 2107/30; F21K 9/232; F21K 9/238; F21K 9/23; F21K 9/235; F21K 9/237

USPC ..... 313/33–51; 362/257–456

See application file for complete search history.

(56) References Cited

U.S. PATENT DOCUMENTS

2016/0131310 A1* 5/2016 Lu ..... F21V 23/06 362/362

2017/0279368 A1* 9/2017 Barbosa ..... H02M 7/06

FOREIGN PATENT DOCUMENTS

CN 103982805 A * 8/2014

* cited by examiner

*Primary Examiner* — Seokjin Kim

(74) *Attorney, Agent, or Firm* — Wang Law Firm, Inc.

(57) ABSTRACT

An LED bulb applicable for industrial automated production includes a bulb body, a lamp holder, an LED driving module, a lamp pole, and a light strip. The bulb body is coupled to the lamp holder. The bulb body is made of a transparent material and in a hollow spherical shape. The lamp pole is installed and integrally fixed into the bulb body. The light strips are installed on the lamp pole and formed into a lamp module, and the light strips are connected in series or in parallel with each other. The LED driving module has a hole at the center sheathed on the lamp pole, so that the LED driving module is disposed in the bulb body. The invention has a simple structure and builds in the LED driving module to simplify the manufacturing procedure and lower the level of difficulty of the manufacture.

5 Claims, 3 Drawing Sheets

LED BULB APPLICABLE FOR INDUSTRIAL AUTOMATED PRODUCTION

FIELD OF INVENTION

The present invention relates to the fields of LED light emission, in particular to an LED bulb applicable for industrial automated production.

BACKGROUND OF INVENTION

1. Description of the Related Art

LED with the advantages of unique light emission property, low power consumption, and good environmental protection is used extensively and increasingly. To meet the requirement for the use of an LED bulb to a traditional lamp holder, it is necessary to provide an appropriate connection for the LED bulb to connect with the traditional lamp holder having a threaded opening or a snap-in device for the purpose of replacing or changing a traditional tungsten bulb or fluorescent bulb, so that the LED bulb can be mass produced and extensively used.

In general, the present LED bulb has a plurality of light emitting strips and the drawbacks of the bulb structure. Specifically, the prevent LED driving module is installed at a corresponding position of the bulb and the lamp cap, so that the LED bulb cannot be entered into an automated production line or manufactured by automated production. In addition, the LED driving module must be connected to the positive and negative electrodes of the lamp cap, and the positive and negative electrodes of the light emitting strip in the bulb body, and thus the installation is troublesome. Particularly, the connection between the LED driving module and the lamp cap requires a process of pulling the leads straight for automatic soldering and installation, but there is no fixing structure between the LED driving module and the bulb body, and they are generally fixed to each other by glue. As a result, the LED driving module may be pulled out easily during the process of pulling the lead, and the LED driving module and the bulb body are separately to cause a poor yield rate of the product. In addition, the conventional structured LED bulb has the lead clamped between glass, and it is necessary to pull the lead out from the glass, and thus the level of difficulty of automation is higher.

The conventional structured LED bulb still cannot be manufactured with a high yield rate by industrial automated production and it cannot meet the industrial automatic production requirement yet. At present, the conventional LED bulb is manufactured by labor according to the aforementioned procedure only, so that the overall production cost of the LED bulb remains very high, and the high cost affects the promotion and application of the LED bulb adversely.

2. Summary of the Invention

Therefore, it is a primary objective of the present invention to overcome the drawbacks of the prior art by providing an LED bulb applicable for industrial automated production.

To achieve the aforementioned and other objectives, the present invention provides an LED bulb applicable for industrial automated production comprising: a bulb body, a lamp holder, an LED driving module, a lamp pole, and a light strip, characterized in that the bulb body is coupled to the lamp holder, and the bulb body is in a hollow spherical shape and made of a transparent material; the lamp pole is installed and integrally fixed into the bulb body; a plurality of light strips is installed on the lamp pole and forms a lamp module, and the light strips in the lamp module are connected in series or in parallel; the LED driving module is in a disc shape with a hole at the center and packaged with an LED chip therein for driving an LED chip in the light strip, and the LED driving module has a plurality of pins extended outwardly from the driving circuit, and a modular structure accomplished by packaging the driving circuit into the reserved pin, and a hole sleeve at the center of the LED driving module is sheathed on the lamp pole, so that the LED driving module is disposed in the bulb body; the LED driving module has two pins coupled to positive and negative electrodes of the lamp holder respectively by a lead; the two pins of the LED driving module are coupled to the positive and negative electrodes of the lamp module for driving the light strips in the lamp module to emit light.

Further, the driving circuit in the LED driving module includes a resistor, a capacitor, and a bridge rectifier. Further, the driving circuit in the LED driving module is a conductor frame structure.

In a preferred embodiment of the present invention, the driving circuit is coupled to the lamp module and the lamp holder through the exposed pins after the driving circuit is packaged, so as to achieve the electrical conduction effect, and the hole sleeve in the packaging structure is sheathed on the lamp pole to achieve a quick assembling effect.

The present invention has a simple structure and builds in the LED driving module to simplify the manufacturing procedure and lower the level of difficulty of the manufacture, so as to improve the yield rate of the product significantly. In addition, the overall structure is simplified and the level of difficulty is lowered, so that an automatic mass production becomes possible and feasible, and such product is worthy to promote and use. With the aforementioned structure, the production procedure and the material consumption can be reduced to lower the production cost effectively.

DESCRIPTION OF THE PREFERRED EMBODIMENTS

The above and other objects, features and advantages of this disclosure will become apparent from the following detailed description taken with the accompanying drawings.

Figure 1:
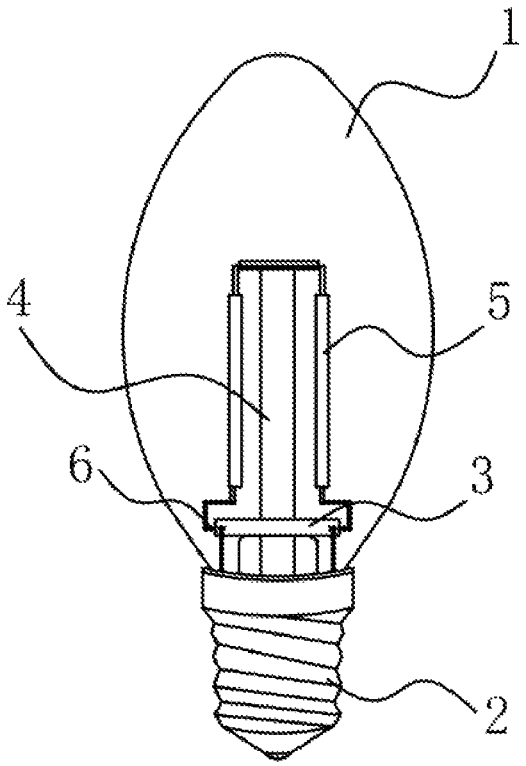
FIG. 1 is a schematic view of an LED bulb applicable for industrial automated production in accordance with the present invention.
Figure 2:
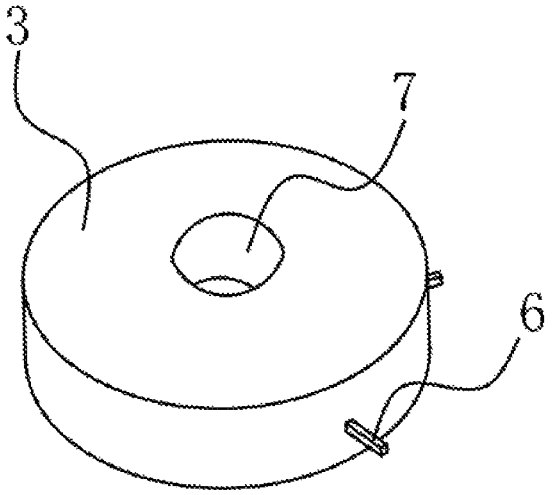
FIG. 2 is a schematic view of an LED driving module in accordance with the present invention.
Figure 3:
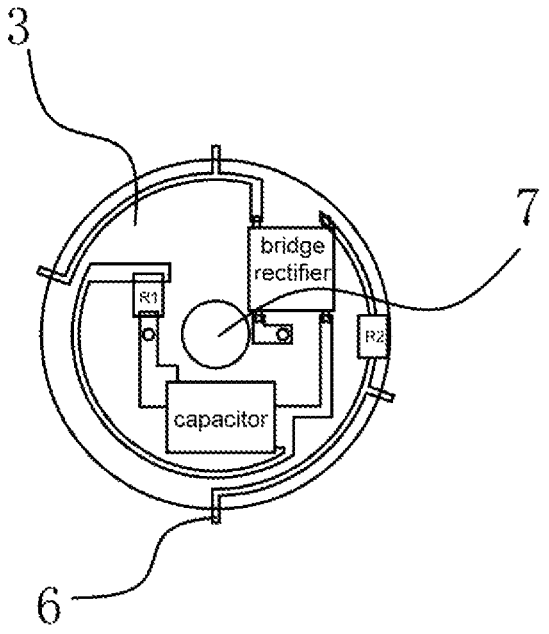
FIG. 3 is a perspective view of an LED driving module in accordance with the present invention.

With reference to FIGS. 1 to 3 for an LED bulb applicable for industrial automated production in accordance with the present invention, the LED bulb comprises a bulb body 1, a lamp holder 2, an LED driving module 3, a lamp pole 4, and a light strip 5, wherein the bulb body 1 is coupled to the lamp holder 2; the bulb body 1 is made of a transparent material and in a hollow spherical shape; the lamp pole 4 is installed and integrally fixed into the bulb body 1; a plurality of light strips 5 is installed on the lamp pole 4 and formed into a lamp module, and the light strips 5 in the lamp module are connected in series or in parallel; the LED driving module 3 is in a disc shape with a hole 7 at the center and packaged with a driving circuit therein for driving an LED chip in the light strip 5 to operate, and the LED driving module 3 has a plurality of pins 6 extended outwardly from the driving circuit, and the pin 6 packaged and reserved in the driving circuit is provided to achieve a modular structure; the hole 7 formed at the center of the LED driving module 3 is sheathed on lamp pole 4, so that the LED driving module 3 is disposed in the bulb body 1; the two pins 6 of the LED driving module 3 are coupled to the positive and negative electrodes of the lamp holder 2 through a lead; and the two pins 6 of the LED driving module 3 are coupled to the positive and negative electrodes of the lamp module, for driving the light strips 5 in the lamp module to emit light. Wherein, the driving circuit in the LED driving module 3 includes a resistor, a capacitor, and a bridge rectifier.

While the invention has been described by means of specific embodiments, numerous modifications and variations could be made thereto by those skilled in the art without departing from the scope and spirit of the invention set forth in the claims.

What is claimed is:

1. A light-emitting diode (LED) bulb applicable for industrial automated production, comprising:

a bulb body, a lamp holder, an LED driving module with a periphery surface, a lamp pole, and a light strip, characterized in that the bulb body is coupled to the lamp holder, and the bulb body is in a hollow spherical shape and made of a transparent material; the lamp pole is installed and integrally fixed into the bulb body; a plurality of light strips is installed on the lamp pole and forms a lamp module, and the light strips in the lamp module are connected in series or in parallel;

the LED driving module is in a disc shape with a hole at a center of the LED driving module and packaged with an LED chip therein for driving an LED chip in the light strip, and the LED driving module has a pair of arc connectors connected to a driving circuit, each arc connector having two pins connected to each arc connector and extending outwardly from the driving circuit in the LED driving module, and a modular structure accomplished by packaging the driving circuit and the plurality of pins, and a hole sleeve at the center of the LED driving module is sheathed on the lamp pole, so that the LED driving module is disposed in the bulb body;

the LED driving module exposes a first set of two pins from the periphery surface for coupling to positive and negative electrodes of the lamp holder and also exposes a second set of two pins from the periphery surface for coupling to positive and negative electrodes of the lamp module.

2. The LED bulb applicable for industrial automated production according to claim 1, wherein the driving circuit in the LED driving module includes a resistor, a capacitor, and a bridge rectifier.

3. The LED bulb applicable for industrial automated production according to claim 1, wherein the driving circuit in the LED driving module is a conductor frame structure.

4. A light-emitting diode (LED) bulb comprising:

a lamp holder;

an LED driving module with a periphery surface mounted on the lamp holder;

a lamp pole mounted on top of the LED driving module;

a lamp module comprising a plurality of light strips mounted on the lamp pole; and a bulb body mounted on the lamp holder enclosing the LED driving module, the lamp pole, and the plurality of light strips, wherein a first set of two pins extend from the periphery surface for coupling to positive and negative electrodes of the lamp holder and a second set of two pins extend from the periphery surface for coupling to positive and negative electrodes of the lamp module.

5. The LED bulb of claim 1, wherein the LED driving module further comprises a driving circuit, a first arc and a second arc connectors connected to a driving circuit, and the first set of two pins are connected to the first arc and the second set of two pins are connected to the second arc.

* * * * *